US006135438A

United States Patent [19]

Newman et al.

[11] Patent Number: 6,135,438

[45] Date of Patent: Oct. 24, 2000

[54] APPARATUS FOR FEEDING SHEETS FROM TWO SEPARATE SOURCES

[75] Inventors: Robert Galon Newman, Lexington; Scott Stephen Williams, Versailles, both of Ky.

[73] Assignee: Lexmark International, Inc., Lexington, Ky.

[21] Appl. No.: 09/292,481

[22] Filed: Apr. 15, 1999

[51] Int. Cl.[7] ..... B65H 3/45; B65H 5/26

[52] U.S. Cl. ..... 271/9.07; 271/9.09; 271/9.11

[58] Field of Search ..... 271/9.07, 9.09, 271/9.11

[56] References Cited

U.S. PATENT DOCUMENTS

| | | | |
|---|---|---|---|
| 4,688,782 | 8/1987 | Browne | 271/9.07 |
| 5,527,026 | 6/1996 | Padget et al. . | |
| 5,622,364 | 4/1997 | Dutton et al. . | |
| 5,862,446 | 1/1999 | Hashizume et al. . | |

FOREIGN PATENT DOCUMENTS

| | | | |
|---|---|---|---|
| 358047737 | 3/1983 | Japan | 271/9.11 |
| 362088737 | 4/1987 | Japan | 271/9.07 |
| 363017742 | 1/1988 | Japan | 271/9.07 |
| 363262351 | 10/1988 | Japan | 271/9.07 |
| 403284555 | 12/1991 | Japan | 271/9.11 |
| 404055231 | 2/1992 | Japan | 271/9.11 |
| 404365730 | 12/1992 | Japan | 271/9.07 |

*Primary Examiner*—Christopher P. Ellis
*Assistant Examiner*—Kenneth W Bower
*Attorney, Agent, or Firm*—John A. Brady

[57] ABSTRACT

A single pick feed mechanism is rotatable between two positions. In a first position, the single pick feed mechanism has its pick rolls rotate in one direction to pick the top sheet of a first source of media. In a second position, the single pick feed mechanism has its pick rolls rotate in the opposite direction to pick the bottom sheet of a second source of media. The first source may have sheets of a different width than the second source. The single pick feed mechanism is disposed between the sources of media.

5 Claims, 6 Drawing Sheets

APPARATUS FOR FEEDING SHEETS FROM TWO SEPARATE SOURCES

FIELD OF THE INVENTION

This invention relates to a sheet feeding apparatus and, more particularly, to a sheet feeding apparatus utilizing a single pick feed mechanism for feeding sheets from two separate sources.

BACKGROUND OF THE INVENTION

Sheets of different sizes have previously been fed from the same source. This has required removing a first stack of sheets of media from a support such as a tray, for example, if a second stack of sheets or even a single sheet rather than a stack is narrower. Then, side guides, which engage and locate the sides of the sheets, must be adjusted to the width of the sheets of the second stack or the single sheet. For example, the first stack could be letterheads, and the second stack or the single sheet could be envelopes.

If the sheets of media of the second stack were placed on top of the sheets of media of the first stack when the sheets of the second stack are narrower, adequate guiding would not be provided to the second stack, and the sheets could not be fed from the second stack without skewing. This is because the side guides must be moved relative to each other for the different widths and the side guides could not be moved inwardly to engage the sides of the narrower sheets of the second stack due to the wider sheets of the first stack.

When the sheets of media in the second stack are wider than the sheets of media in the first stack, it is not necessary to remove the first stack of sheets from the tray because the side guides can be pulled laterally from the sides of the narrower sheets of the first stack of media to accommodate the wider sheets of the second stack. However, when it is again desired to feed the narrower sheets of the first stack of media, the second stack of sheets of media must be removed in order to move the side guides inwardly against the sides of the narrower sheets of the first stack of media. Therefore, the feeding of sheets of different widths has been a time consuming task.

SUMMARY OF THE INVENTION

The sheet feeding apparatus of the present invention satisfactorily solves the foregoing problem by utilizing a single pick feed mechanism for feeding sheets of media from two separate addressable feed sources. This is accomplished by disposing the single pick feed mechanism between the two sources and selectively moving the single pick feed mechanism from feeding sheets from one of the sources through picking the top sheet from its stack to feeding sheets from the other of the sources through picking the bottom sheet from its stack.

An object of this invention is to provide a sheet feeding apparatus for feeding sheets of media from two different sources with a single pick feed mechanism.

Another object of this invention is to provide a sheet feeding apparatus for feeding sheets of media of two different widths from two stacks with a single pick feed mechanism without having to interrupt feeding to load and/or remove either stack.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
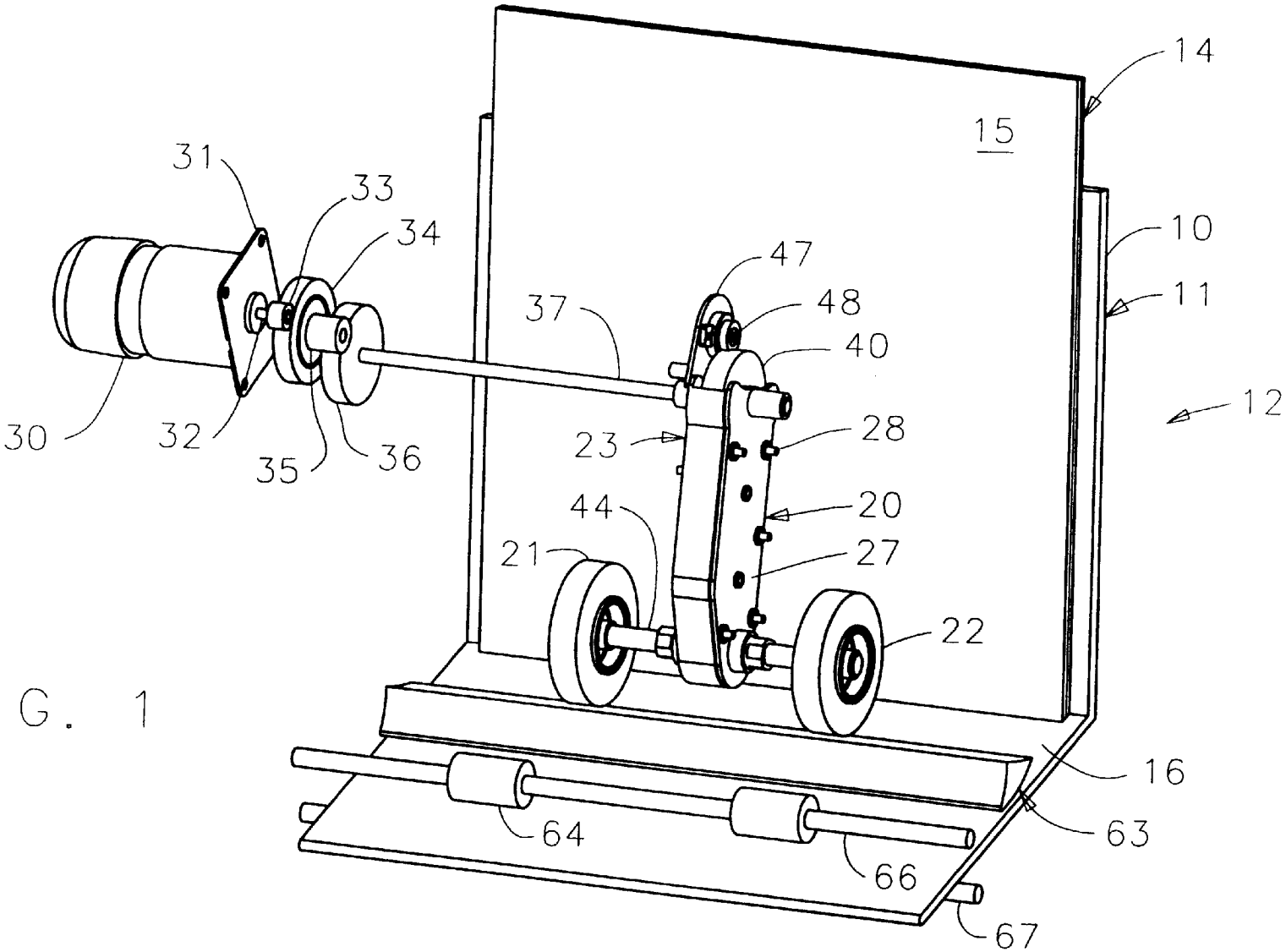
FIG. 1 is a front perspective view of one embodiment of a sheet feeding apparatus of the present invention with a tray and a cover, which are utilized to support a second source of sheets, being removed to show its pick feed mechanism.
Figure 2:
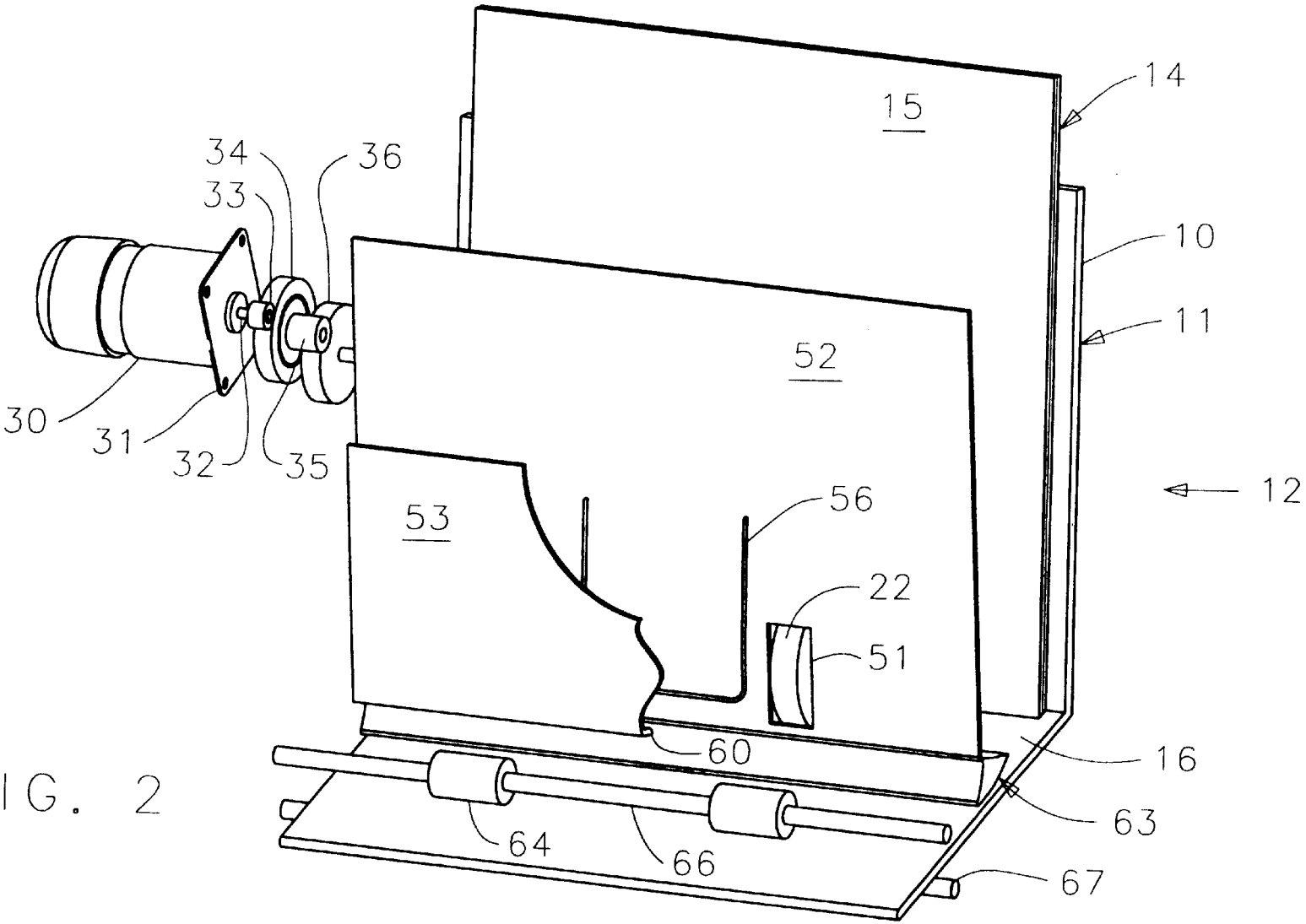
FIG. 2 is a front perspective view of the sheet feeding apparatus of FIG. 1 with the tray and a portion of the cover, which are utilized to support the second source of sheets, being shown.

Referring to the drawings and particularly FIG. 1, there is shown an inclined portion 10, which is substantially vertical, of a frame 11 of a laser printer 12. A stack 14 of sheets 15 of media such as paper, for example, which constitutes a first source, is supported by the inclined portion 10 of the frame 11 and a sheet separating dam 16. The sheet separating dam 16 is integral with the inclined portion 10 of the frame 11 and extends substantially horizontal.

A pick feed mechanism 20, which is preferably an autocompensator of the type shown and described in U.S. Pat. No. 5,527,026 to Padget et al and incorporated by reference herein, includes a pair of pick rolls 21 and 22. It should be understood that the pick feed mechanism 20 could be other than the autocompensator of the aforesaid Padget et al patent and could have only one of the pick rolls 21 and 22, if desired.

Figure 3:
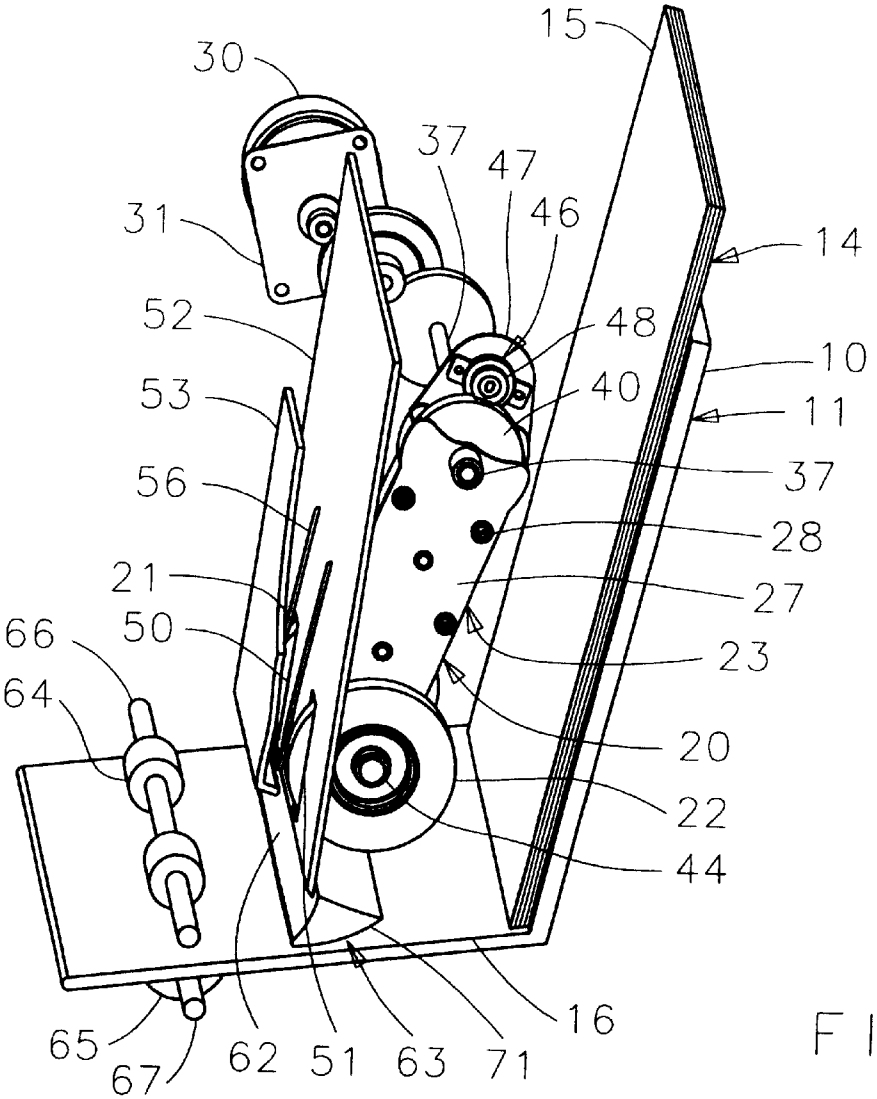
FIG. 3 is a perspective view of the sheet feeding apparatus of FIG. 1 and taken from the right side of FIG. 2.

The pick feed mechanism 20 includes a housing 23 having a base 24 (see FIG. 4) and a wall 25 integral with the base 24 and extending substantially perpendicular therefrom. A cover 27 (see FIG. 3) is removably attached to the base 24 (see FIG. 4) by having snap fasteners 28 (see FIG. 3) receive studs 29 (see FIG. 4) extending substantially perpendicular from the base 24 of the housing 23.

A reversible electric motor 30 (see FIG. 1) is supported by the frame 11 through having a mounting plate 31 attached to a side portion (not shown) of the frame 11. The motor 30 has its shaft 32 rotate a gear 33 attached thereto. The gear 33 is part of a gear train including gears 34, 35, and 36.

An input shaft 37 is attached to the gear 36 and is supported by a side portion (not shown) of the frame 11 between the gear 36 and the left side of the inclined portion 10 of the frame 11. The input shaft 37 could extend to a side portion (not shown) of the frame 11 on the right side of the inclined portion 10 of the frame 11, if desired.

Figure 4:
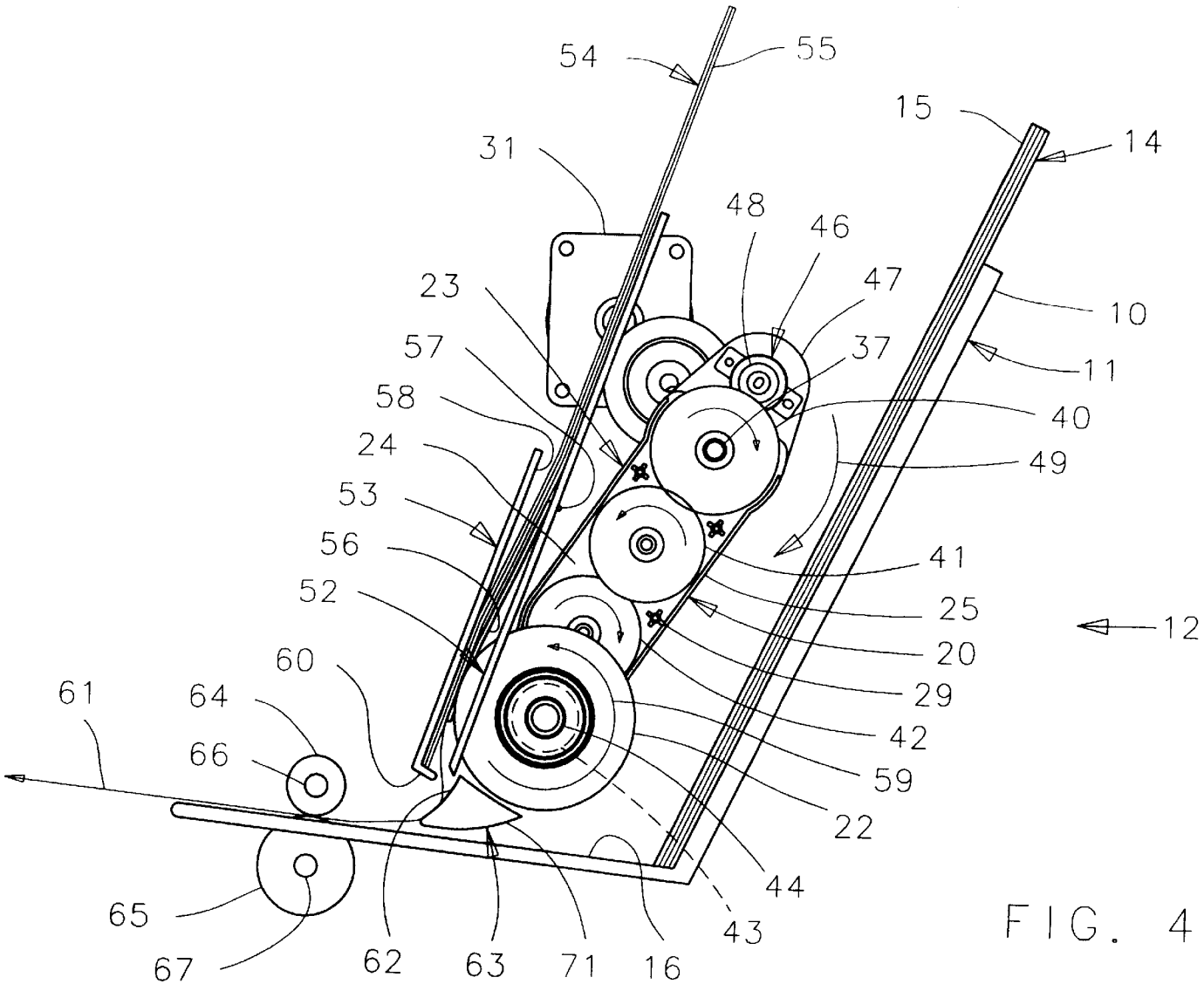
FIG. 4 is a side elevation view of the sheet feeding apparatus of FIG. 1 in which the single pick feed mechanism is feeding sheets of media from the bottom of a stack of sheets of media constituting the second source.

The input shaft 37 also is attached to a gear 40 (see FIG. 4). The input shaft 37 extends through the gear 40 and through the housing cover 27 (see FIG. 3). Thus, the gear 40 rotates with the input shaft 37 and is supported thereby. A clip (not shown) holds the input shaft 37 in the cover 27 while permitting the input shaft 37 to rotate.

The gear 40 rotates the pick rolls 21 and 22 through a gear train. The gear train includes gears 41 (see FIG. 4), 42, and 43. The gear 43 is connected to a shaft 44 (see FIG. 1) to which the pick rolls 21 and 22 are connected. Thus, rotation of the gear 40 about its axis of rotation rotates the pick rolls 21 and 22.

A fluid damper 46 (see FIG. 4) is attached to the housing 23 by being secured to an extension 47 of the base 24 of the housing 23. The fluid damper 46 includes a gear 48 meshing with the gear 40. The gear 48 is disposed in a viscous material such as grease, for example, within the fluid damper 46.

Figure 5:
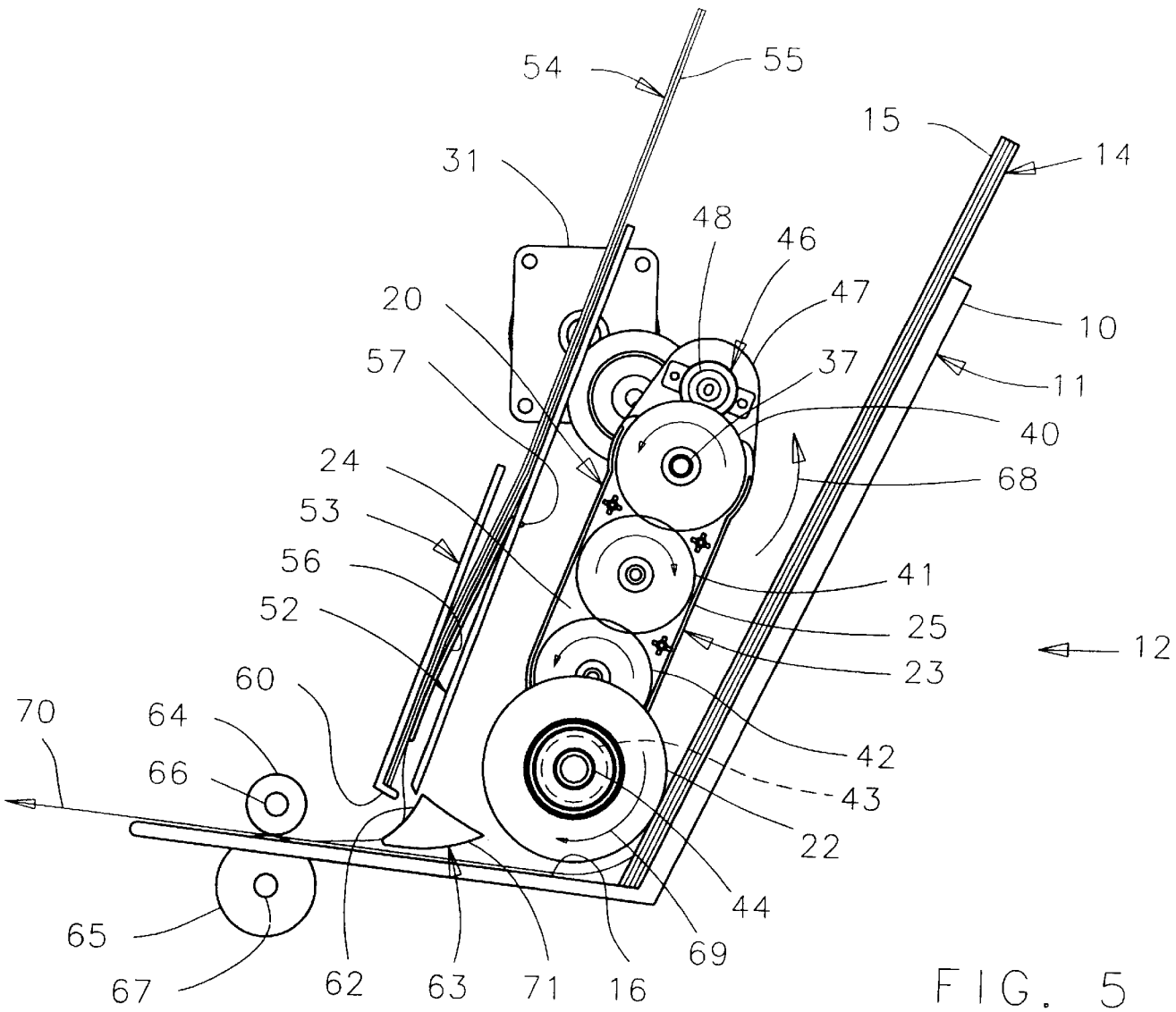
FIG. 5 is a side elevation view of the sheet feeding apparatus of FIG. 1, similar to FIG. 4, in which the single pick feed mechanism is feeding sheets of media from the top of a stack of sheets of media constituting the first source.

Accordingly, when the gear 40 is rotated clockwise (as viewed in FIG. 4), the housing 23 is rotated clockwise, as indicated by an arrow 49, about the axis of the input shaft 37 to the position of FIG. 4 from the position of FIG. 5. The clockwise (as viewed in FIG. 4) rotation of the housing 23 is produced by the fluid damper 46 creating a drag component on the housing 23 to induce a torque therein. It should be understood that the drag component on the housing 23 can be produced by any suitable device capable of imparting a drag component or any suitable device capable of imparting a torque.

This clockwise rotation of the housing 23 moves the pick rolls 21 (see FIG. 3) and 22 through slots 50 and 51, respectively, in an inclined tray 52. The tray 52 is supported by side portions (not shown) of the frame 11.

An inclined cover 53 (see FIG. 4), which is substantially parallel to the tray 52, is spaced from the tray 52 to receive a stack 54 of sheets 55 of media such as paper, for example, therebetween. The stack 54 of the sheets 55 of media constitutes a second source. The cover 53 is supported by side portions (not shown) of the frame 11.

A flat, U-shaped spring 56 has its two free ends 57 extending through two holes (not shown) in the tray 52. The spring 56 engages the lowermost sheet 55 in the stack 54 of media and urges the uppermost sheet 55 in the stack 54 of media against an inner surface 58 of the cover 53.

When the housing 23 is in the position of FIG. 4, the lowermost sheet 55 of media of the stack 54 is advanced from the stack 54 by the pick rolls 21 (see FIG. 1) and 22 rotating counterclockwise as indicated by an arrow 59 in FIG. 4. The picked bottom sheet 55 of the stack 54 of media has its leading edge initially engage a sheet separating dam 60 on the bottom end of the cover 53. The sheet separating dam 60 separates the picked bottom sheet 55 of media from the remaining sheets 55 in the stack 54.

The feed path of the picked sheet 55 of media is indicated by a line 61. Thus, after the leading edge of the sheet 55 passes over the sheet separating dam 60, a curved surface 62 of a guide 63 engages the leading edge of the sheet 55 and directs it between a pair of feed rolls 64 and 65. The guide 63 is supported by side portions (not shown) of the frame 11.

The feed rolls 64 and 65 are attached to shafts 66 and 67, respectively, for rotation therewith. The shafts 66 and 67 are rotatably supported in side portions (not shown) of the frame 11. One of the feed rolls 64 and 65 is driven by a motor (not shown) rotating the shaft 66 or 67 to rotate both of the feed rolls 64 and 65.

When it is desired to shift the pick feed mechanism 20 from the position of FIG. 4 to the position of FIG. 5 to feed the sheets 15 of media from the stack 14, the direction of the motor 30 (see FIG. 1) is reversed. This is preferably accomplished by software in the printer 12.

Accordingly, the direction of rotation of the motor 30 is reversed so that the gear 40 rotates counterclockwise (as viewed in FIG. 5). This causes the housing 23 to rotate counterclockwise, as indicated by an arrow 68, about the axis of the input shaft 37 and the axis of rotation of the gear 40 since they are axially aligned.

As a result of the counterclockwise rotation of the housing 23, the pick rolls 21 (see FIG. 1) and 22 engage the uppermost sheet 15 (see FIG. 5) of media in the stack 14. The pick rolls 21 (see FIG. 1) and 22 are rotating clockwise, as indicated by an arrow 69 in FIG. 5 for the pick roll 22, to advance the uppermost sheet 15 of media from the stack 14.

When the uppermost sheet 15 of media is advanced from the stack 14, the uppermost sheet 15 has its leading edge advanced along the sheet separating dam 16 to separate the sheet 15 from the remainder of the stack 14. Then, the sheet 15 is fed along a path indicated by a line 70 in FIG. 5.

The guide 63 has a curved surface 71 disposed to guide the sheet 15 of media between the feed rolls 64 and 65. After leaving the feed rolls 64 and 65, the sheet 15 of media or the sheet 55 of media is advanced by the feed rolls 64 and 65 into a nip formed between a toner roll 72 (see FIG. 6) and a transfer roll 73. A cartridge 74 of the laser printer 12 has toner therein for supply therefrom through the toner roll 72 for application to selected portions of the sheet 15 (see FIG. 4) or 55 of media to print thereon. This constitutes a processing station at which printing on the sheet 15 or 55 of media occurs.

Then, the sheet 15 or 55 of media is fed through feed rolls 75 (see FIG. 6) and 76 of a fuser 77 at which the printed matter is fixed to the sheet 15 (see FIG. 4) or 55 of media. Next, the sheet 15 or 55 of media is fed through feed rolls 78 (see FIG. 6) and 79 and feed rolls 80 and 81 to a curved surface 82 on which the sheets 15 or 55 (see FIG. 4) of media are stacked for storage as indicated at 83 in FIG. 6. It should be understood that the feed rolls 75, 76, and 78–81 are supported and driven in the same manner as the feed rolls 64 and 65.

Figure 6:
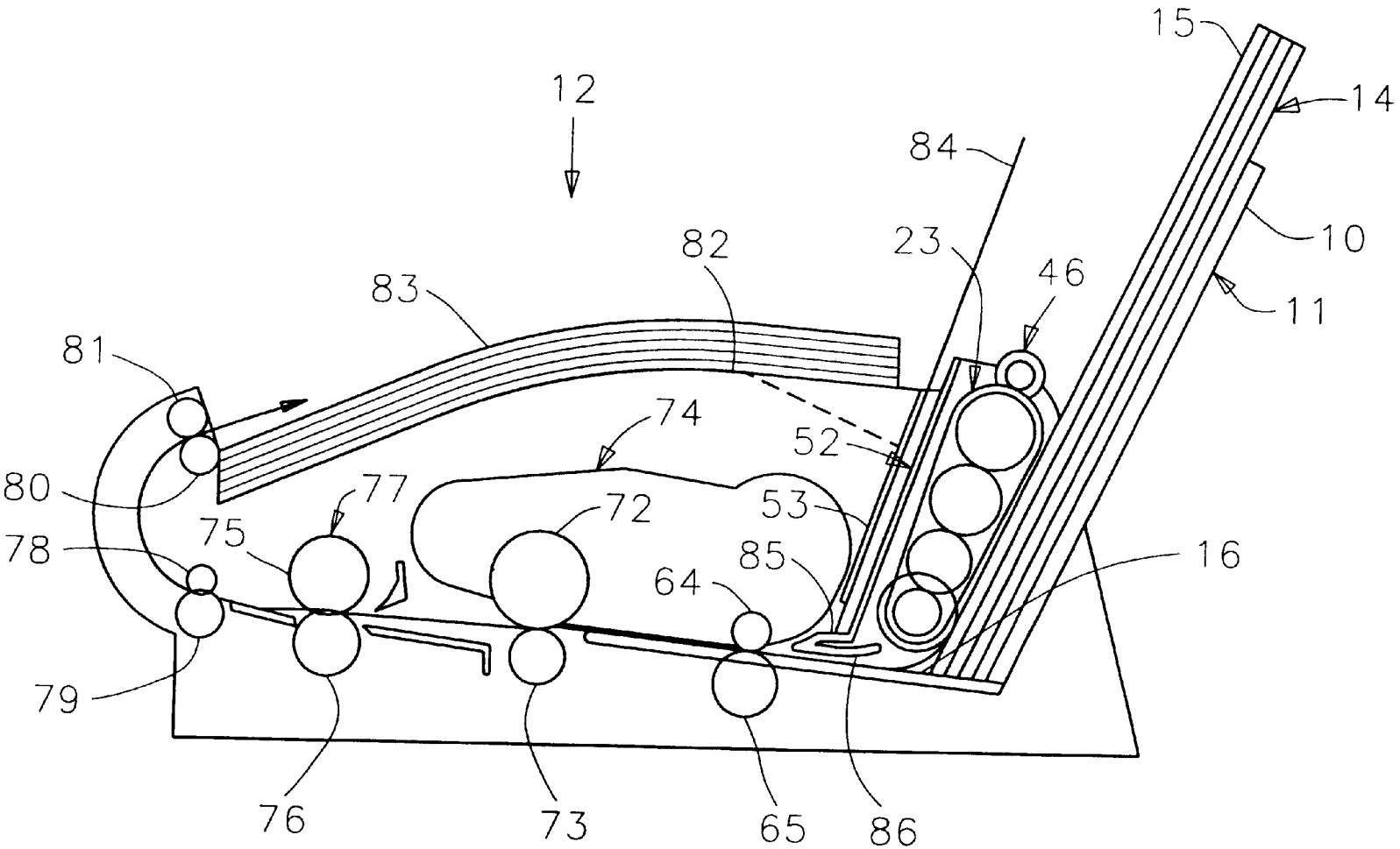
FIG. 6 is a schematic side view of another embodiment of the sheet feeding apparatus of the present invention in which the second source is designed for single sheet feeding only.

FIG. 6 shows only a single sheet 84 of media disposed between the tray 52 and the cover 53 rather than the sheets 55 (see FIG. 5). Because only the single sheet 84 (see FIG. 6) can be used in this embodiment, the cover 53 does not require the flat spring 56 (see FIG. 4) or the sheet separating dam 60 on the bottom end of the cover 53.

The guide 63 also is not needed. Instead, the tray 52 (see FIG. 6) has a dam surface 85 adjacent its bottom end for supporting the single sheet 84 of media and guiding the single sheet 84 of media between the feed rolls 64 and 65 and a guide surface 86 beneath the guide surface 85 for guiding each of the sheets 15 of media along the sheet separating dam 16 and away from the stack 14 to the feed rolls 64 and 65. The rotation of the housing 23 between its two positions in the embodiment of FIG. 6 is the same as described for the embodiment of FIGS. 1–5.

While the gear 40 (see FIG. 4) has been shown and described as attached to the input shaft 37 for rotation therewith and support thereby, it should be understood that the gear 40 could be rotatably mounted on a fixed shaft, which would be supported by portions (not shown) of the frame 11, with the input shaft 37 have another gear attached thereto for meshing with the gear 40. Thus, it is not necessary for the gear 40 to be attached to the input shaft 37. However, the gears 40, 41, 42 and 43 must be freely rotatable relative to the housing 23 and the housing 23 must have its axis of rotation aligned with the axis of rotation of the gear 40 in order for the housing 23 to be capable of moving between the positions of FIGS. 4 and 5.

While the gear 48 (see FIG. 4) has been shown and described as engaging the gear 40 to create the drag component, it should be understood that the gear 48 may engage any of the gears 41–43 of the gear train instead of the gear 40.

It should be understood that each of the dam 16 (see FIG. 1), the dam 60 (see FIG. 4), and the dam surface 85 (see FIG. 6) has longitudinal ribs and friction pads. One suitable example of such longitudinal ribs and friction pads on a dam is shown and described in the copending patent application of Stephen A. Oleksa et al, Ser. No. 08/879,351, filed Jun. 20, 1997, now U.S. Pat. No. 5,895,040; for "Sheet Separator" and assigned to the same assignee as this application.

An advantage of this invention is that media such as paper, for example, of different sizes may be fed by a single pick feed mechanism. Another advantage of this invention is that two different sources of sheets of media may be preloaded. A further advantage of this invention is that sheets of media of different widths may be fed without having to stop operation of a printer.

For purposes of exemplification, preferred embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A sheet feeding apparatus for selectively feeding sheets from two separate sources including:

a first source of a stack of sheets;

a second source of at least one sheet and spaced from said first source;

single pick means for selectively picking a sheet from either of said first source and said second source;

and said single pick means including:

at least one pick roll for engaging a sheet to be picked from said first source when said single pick means is in a first position and for engaging a sheet from said second source when said single pick means is in a second position;

means for rotating said at least one pick roll in a desired direction to pick a sheet from one of said first and second sources in accordance with whether said at least one pick roll is in said first or said second position;

a housing;

rotatable supporting means for rotatable supporting said housing;

drive means for rotating said pivot gear about an axis of rotation;

means for transmitting rotation of said pivot gear to rotate said at least one pick roll in the desired direction when in said first or said second position;

said transmitting means and said at least one pick roll being rotatably mounted within said housing so as to rotate relative to said housing;

and said selectively moving means including causing means for causing rotation of said housing to move said at least one pick roll about the axis of rotation of said pivot gear from one of said first and said second positions to the other when said at least one pick roll is to be shifted from engagement with a sheet of one of said first and said second sources to the other;

said causing means including rotation causing means for causing rotation of said housing in response to rotation of said pivot gear, said rotation causing means being mounted on said housing;

said transmitting means including a gear train having a plurality of gears, one of said gears engaging said pivot gear and another of said gears being coupled to said at least one pick roll;

and said rotation causing means including drag means having a gear supported by said housing and engaging one of said pivot gear or one of said gears of said gear train, said gear of said drag means being disposed in a viscous material to retard it rotation to create a drag between said engaged gear and said housing to rotate said housing in response to rotation of said pivot gear.

2. The apparatus according to claim 1 including means for defining a common feed path for a sheet from either of said first source and said second source to a processing station.

3. The apparatus according to claim 2 including:

a first sheet separating dam for engaging a leading edge of a sheet from said first source to separate the sheet from the remaining sheets in the stack;

a second sheet separating dam for engaging a leading edge of a sheet from said second source to separate the sheet from the remaining sheets in the stack;

and sheet directing means for directing the separated sheet into the common feed path.

4. The apparatus according to claim 3 including:

said first source including first support means for supporting a stack of sheets;

said second source including second support means for supporting a stack of sheets;

and said rotatably supporting means for said housing being disposed between said first support means and said second support means.

5. The apparatus according to claim 4 including resilient means supported by said second support means for exerting a force on the sheets supported by said second support means to hold the sheets on said second support means, said resilient means being supported by said second support means.

* * * * *